United States Patent [19]

Massie

[11] Patent Number: 4,965,417

[45] Date of Patent: Oct. 23, 1990

[54] FOOT-OPERATED CONTROL

[76] Inventor: Philip E. Massie, 4220 Irving Place, Culver City, Calif. 90232

[21] Appl. No.: 328,895

[22] Filed: Mar. 27, 1989

[51] Int. Cl.[5] ..... H01H 21/26

[52] U.S. Cl. ..... 200/86.5; 74/560; 335/207

[58] Field of Search ..... 74/478, 478.5, 560 X, 74/561; 200/61.89, 86.5; 335/207 X; 338/69, 108; 84/444

[56] References Cited

U.S. PATENT DOCUMENTS

| | | | |
|---|---|---|---|
| 3,255,326 | 6/1966 | Schwartz | 200/86.5 |
| 3,381,565 | 5/1968 | Haile | 84/444 |
| 3,761,598 | 9/1973 | Haile | 84/444 |
| 3,841,172 | 10/1974 | Pilch | 74/560 |
| 3,972,403 | 8/1976 | Van Alstine | 335/207 |
| 4,543,569 | 9/1985 | Karlstrom | 200/86.5 |

*Primary Examiner*—Gerald P. Tolin
*Attorney, Agent, or Firm*—Evanns & Walsh

[57] ABSTRACT

The invention as disclosed is a control mechanism adapted for actuation by a human, in the exemplary embodiment by a person's foot. The invention provides for control or actuation of a plurality of devices to be controlled. A plurality of control elements, preferably arranged arcuately with respect to an actuating member is provided with a structure for accurately indexing the actuating member to a particular control element by way of one mode of movement and for actuating an individual indexed control element of a second mode of movement. Particular structure is provided, by way of a foot pedal, in the exemplary embodiment, with particular adjustments so as to adapt the actuating member, that is, the foot pedal, to various sizes and positions of an operator's foot, as well as amplitude of actuating movement.

17 Claims, 5 Drawing Sheets

FIG. 1
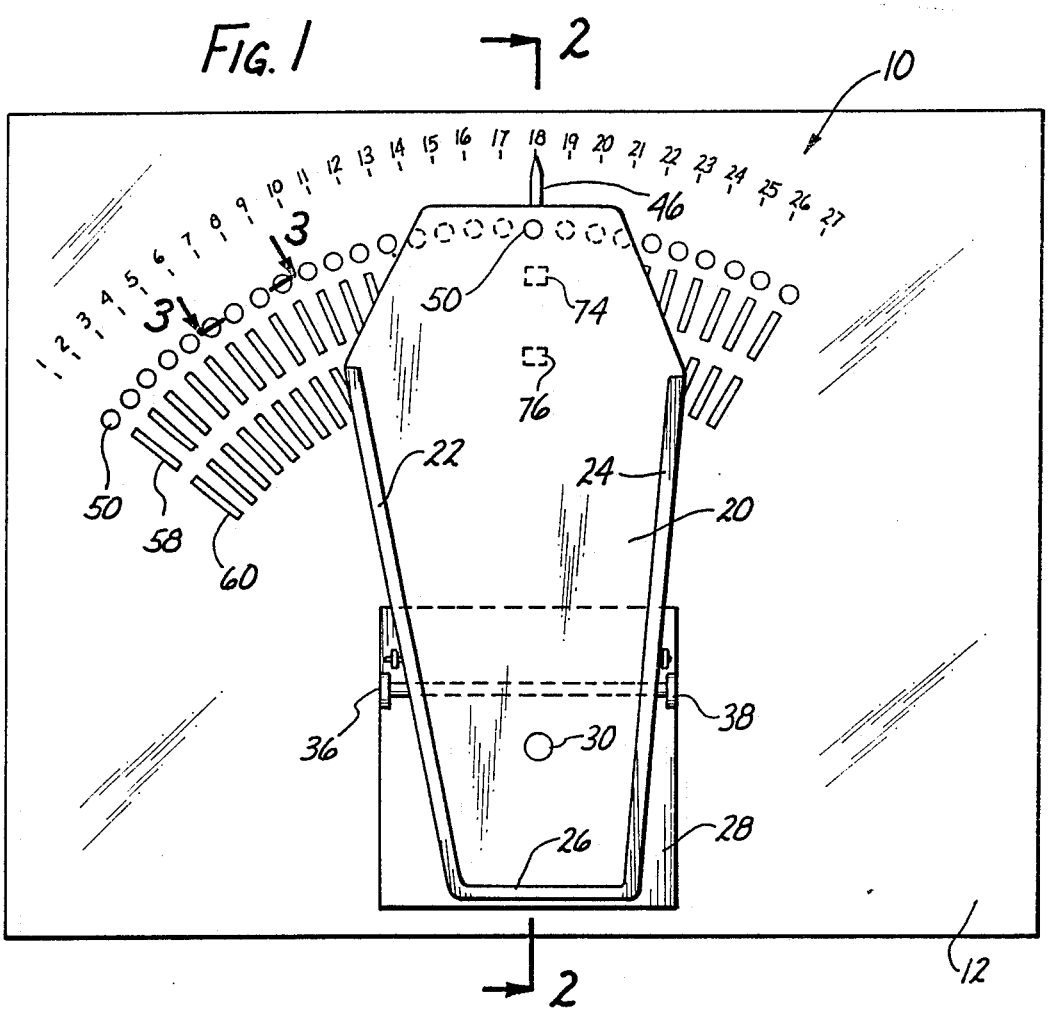
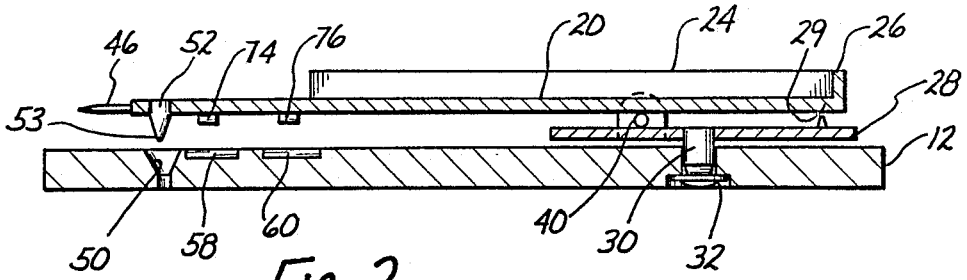
FIG. 2
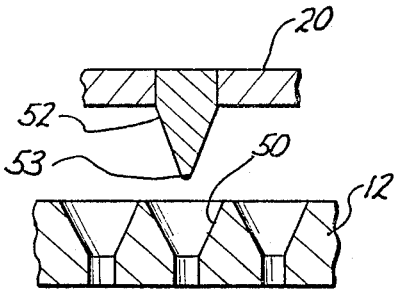
FIG. 3

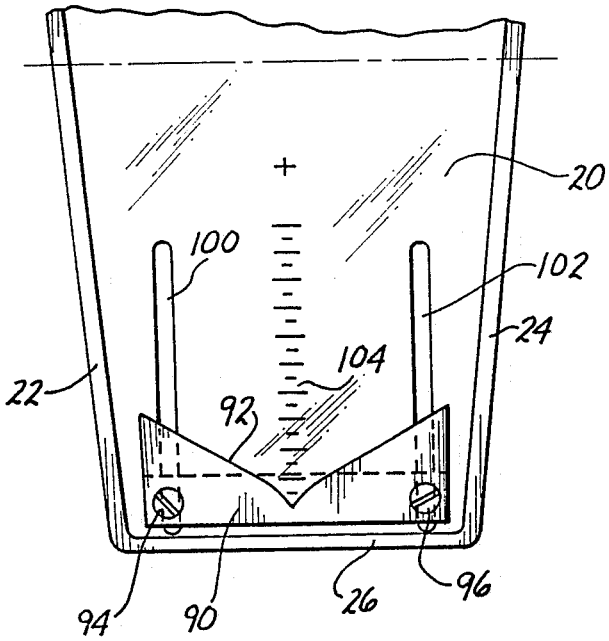
FIG. 6
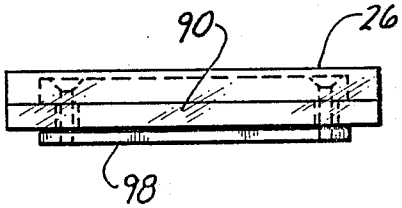
FIG. 7
FIG. 8
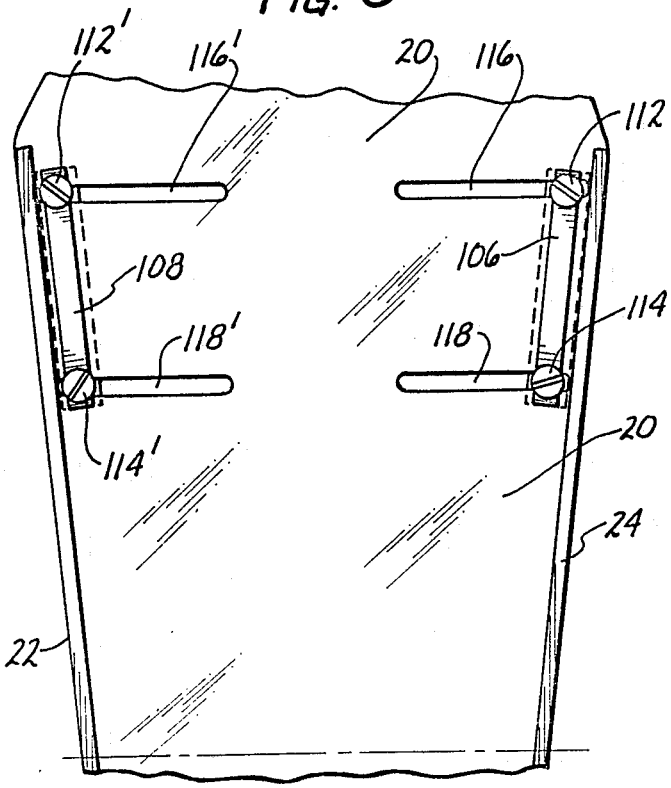
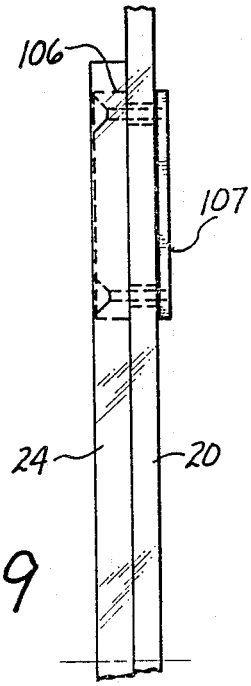
FIG. 9

FOOT-OPERATED CONTROL

BACKGROUND OF THE INVENTION

1. Field of the Invention

The field of the invention relates to a mechanism, by way of example, switching, of a type adapted to be operated by a human and more particularly by a foot of an operator. The field of course includes a number of different areas where such switching or control mechanism is adapted for use as will appear more clearly hereinafter.

2. Description of the Prior Art

In the field of switches or, more broadly, controlled devices, there is frequently a requirement for an operator to control more than two device or controls simultaneously. This can be alleviated or accomplished with a device designed for control or operation by the foot. The hands control the other devices, for example, two other devices. A device of this type is also applicable to operation by a handicapped person or operator with one or both hands incapacitated. An example may be said to be the pedal board of an organ or a "foot board" musical instrument, types of which exist for use by a performer using the hands for operation of some other musical instrument. Serious limitations in such a device as known has been the requirement for wide spacing of the control keys or control elements to accommodate the size of the foot or shoe of the operator. This has limited the span of the foot part/pedal part to such as can be reached conveniently, based on the length of the leg or legs; the ability to spread and rotate the legs and the stability of the operator with spread legs whether seated or standing. This condition is one that, as will be stated, is among the objects of the invention to mitigate or ameliorate.

The closeness of spacing of control keys or control elements for operation by the foot has been limited by the size of the foot/shoe and the limitation that only one key or control element should be operated at one time by the width of the foot/shoe. The existing organ pedal boards require lateral displacement of the foot/leg to reach the keys or control elements. This does not permit a fixed foot placement. This deficiency is among those which, as will be stated, are objects of the invention to overcome.

Having reference to devices that have been referred to above, training for the accurate positioning of the foot has usually been minimal through the generations of man when compared to the accuracy of the hand and fingers. As will be stated, one of the objects of the herein invention is that it will assist in accurate and selective operation of the controls while position accuracy capability of the foot is or continues limited. In the field of music, for example, a performer can select and operate one musical tone to complement his manual and vocal performance. The voicing of the "foot board" is a skill widely practiced in equipment manufactured by some firms. In addition to the selected musical range of keys, volume controls and selected different voices can be made subject to the control elements (The pitch of the musical instrument relates to changes that can be made in frequencies (i.e. oscillator frequency) used. Voice is the characteristic tone or timbre of the specific instrument, that is, the musical sound that is produced.)

The limitation on the number of keys or control elements available to the performer is limited by the ability to comfortably rotate the foot both while standing and while seated and by the minimum spacing that the performer can discriminate between keys or control elements.

Ordinary rotary switches are of course well known in the art whether or not adaptable at all to the requirements of the control device of the herein invention. It is not possible to selectively jump from one contact to another with contacts in between those two. Typically, the torque is too high. The static friction (stiction) is too high. Also on a rotary switch the number of positions is too small, such as possibly 6 or 12. Typically, the most common types require nearly a full revolution to reach this number of positions and are designed for hand operation. They could not be operated by a foot, for example.

Brush-type sliding electrical contact rotary switches are very expensive and typically there is overlap between contacts rendering them unacceptable for this purpose. Such devices have the same stiction problem as anti-torque devices such as Teflon devices with additional deficiencies. Also, they are subject to wear, arcing electrical noise, contact corrosion noise and wear. Known rotary switches of the type described are the subject of many deficiencies particularly in the context of the herein invention. Few of these devices are sealed against corrosion and contamination.

The herein invention produces and makes available a device that has capabilities not possessed by and have not previously been available in the prior art. The device of the invention will have many applications or uses as will be elucidated hereinafter.

SUMMARY OF THE INVENTION

Preferred forms of the invention are disclosed in detail hereinafter. In a preferred form of the invention operation is made possible by a foot/shoe transmitted through a pedal having a small actuator on it able to operate closely spaced control elements, as, for example, switch contacts, by rotating the pedal about an axis to selectively control, and by another movement of the pedal such as tilting or tipping about another axis to engage or operate or actuate the switch or control element.

In a preferred form of the invention to assist in positioning the actuator accurately and selectively, a tapered pin or an indexing pin is provided to be operated by the pedal in association with tapered holes placed in a board or surface in order to register the pedal actuator device or member accurately and selectively with the selected switch or element to be operated or activated.

It has been experimentally determined that the foot can be rotated comfortably about eighty angular degrees (80°) while standing and can rotate much farther with some strain on the leg and with rotation of the body and the other leg. This expanded rotation can be utilized for those limited functions such as volume change and selection of instrument voice in musical instruments. An angular spacing between musical keys or elements of about three angular degrees (3°) has been found practical. Lesser spacing is possible with training and practice. Thus an instrument for a novice might have about 25 keys with about three degrees (3°) spacing while a similar instrument for the practiced performer might have many more keys or control elements at a smaller angular spacing.

The ergonomics of a foot instrument are significantly important and have not been significantly addressed in the past. A stand-up performer will desire to stand comfortably for some period, such as 15 to 45 minutes. As stated, this element of ergonomics has not been met in the past.

The standing position must be comfortable. It has been found experimentally that the rotation or vertical axis of the pedal should be somewhere in the forward part of the instep of the foot. The tilting or horizontal axis should be significantly forward of the heel so that the performer can stand comfortably on both feet with the weight evenly distributed when the pedal is not tilted to operate a tone. The amount of pedal angular tilt should be the minimum to permit clearance of an indexing pin as it is rotated above the baseboard, switches and tapered holes and control elements when selecting a tone. The pedal should be fabricated such that the positions can be adjusted to suit the bodily configuration and performance of the performer. These design parameters will also apply if the performer is seated on a high stool such as frequently used in a place of entertainment, i.e., restaurant bar, lounge or stage.

The device as referred to permits spacing keys, switches or elements to be activated as closely as the training and skill of the operator will permit. The pin or index pin actually assures that only one switch or control element will be actuated and the actuator will be registered. In a preferred form to achieve the positioning of the pedal accurately and selectively, the tapered pin or index pin is used on the bottom of the pedal, and it cooperates with tapered holes in a base or board to register the pedal actuator device or member accurately and selectively with the selected member to be actuated. The taper of the pin and the hole permits the operator to accurately and selectively choose a device to be controlled while approaching that location with an accuracy, for example, less than half the span between the control elements. The taper of the pin and the hole controls the actuator member into registration with the element to be actuated as the pedal is depressed or otherwise moved for this purpose. This reduces the training and skill accuracy requirement of the operator. Operators with minimal skill and training can quickly learn the operation of the device.

One example of the use of a preferred form of the invention is a "foot board" musical instrument for use by a performer using both hands to perform some other instrument. It is frequently desirable to have a musical bass instrument accompany as background or foundation to a guitar, piano or electronic keyboard as well as other instruments requiring two hands to operate. The solo guitar player (and singer) can perform as usual and have the reinforcement of a foundation bass instrument to add depth and diversity to the performance. The foundation bass is typical of most modern music and creates a base for the higher voices. The bass viol (string bass), electric bass guitar (electric bass), tuba sousaphone (euphonium), and other reed horns and "lip" horns (brass) provide the foundation bass for various musical forms.

In a preferred form of the invention as referred to above the device has a rotatable and tiltable pedal with tapered indexing pin on the bottom of the pedal and multiple tapered holes in a baseboard as described for location and accurate registration to the selected key/-tone. The base board of the device contains a series of magnetically operated and sealed reed switches positioned on a radius about the vertical rotation axis of the pedal and recessed in the baseboard to prevent breakage. Magnetic reed switches are, of course, well known and will be described in more detail hereinafter. The reed switches are operated by a permanent magnet which is attached to the underside of the pedal in such a position that it will influence one and only one magnetic reed switch for any registration of the tapered index pin in a selected tapered hole when the pedal is tilted or otherwise moved in a mode to accomplish the purpose. The performer can select and operate one musical tone to complement his manual and vocal performance such as changing the frequency of the generator.

To assist in positioning the pedal actuator to the desired musical tone during training and learning some form of good visual registration marks preferably are placed on the baseboard and a suitable pointer or indicator is placed on the pedal. The reed switch actuator and the index pin need not be visible to the performer. Registration marks can be employed to register the desired positions visually with sufficient accuracy that the tapered index pin and tapered holes will pull the pedal magnetic actuator onto the correct reed switch. With practice the performer will learn to position the pedal rotatably without visual reference.

A rest will be provided for the non-performing foot/-leg to place the foot at an elevation equal to the pedal.

In the light of the foregoing, the primary object of the invention is to provide and make available an instrument or component which makes available the capabilities which have already been identified in the foregoing.

More specifically, an object of the invention is to provide a control instrument or device capable of having control elements such as switches operable by, for example, the foot of a human being in an accurate, efficient and comfortable way.

A further object is to achieve a device as in the foregoing which achieves all of the capabilities not previously available as well as overcoming all of the deficiencies that have been identified.

Further objects and advantages of the invention will become apparent from the following detailed description and annexed drawings.

BRIEF DESCRIPTION OF THE DRAWINGS

FIG. 1 is a plan view of a preferred form of the invention;

FIG. 2 is essentially a longitudinal sectional view of FIG. 1 in which some elements are more clearly identified;

FIG.3 is an enlarged detail view of the tapered pins and holes of FIG. 2 to illustrate them more fully;

FIG. 6 is a detail plan view of the foot/shoe size fore and aft adjustment that may be used in the device of FIGS. 1 and 2;

FIG. 7 is an end view of the adjustment device of FIG. 6;

FIG. 8 is a plan view of an adjustment device, that is, toe adjustment adapted for use in the structure of FIGS. 1 and 2;

FIG. 9 is a side elevation of the adjustment device of FIG. 8;

DESCRIPTION OF PREFERRED EMBODIMENTS AND BEST MODE OF PRACTICE OF THE INVENTION

Reference is made more particularly to FIGS. 1 through 5, 6–9, 12 and 13.

Figure 12:
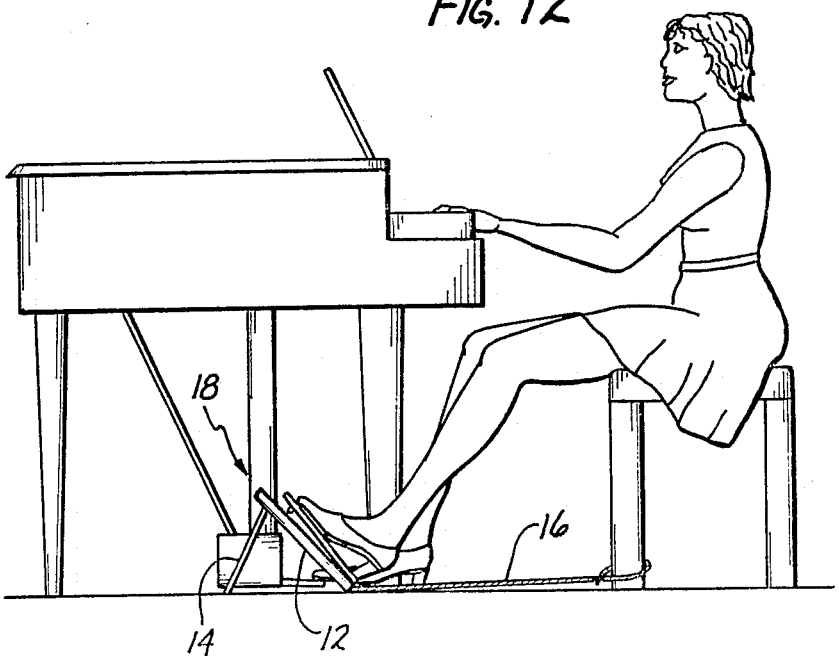
FIG. 12 is a pictorial view of the invention as used with a piano or organ.

A preferred form or embodiment is illustrated in the figures referred to. In FIG. 1 numeral 10 is a plan view of the foot operated control device which in this embodiment embraces a plurality of electrically operated switches. Numeral 12 designates a base board which may be mounted in a horizontal flat position to be operated by a person in a standing position. On the other hand, the base board 12 may be positioned as shown in FIG. 12 supported by a brace 14. This is a position that would accommodate a human operator sitting on a bench and operating a piano or an organ. In this position the device can be secured by a tether or leash 16 to a leg of the seat to prevent it from sliding forwardly away from the position of the operator.

In FIG. 1, numeral 20 designates a pedal preferably having a shape as shown and having side members 22 and 24 and a rear member 26. Adjustment parts may be provided as illustrated in FIGS. 4–9 which will be referred to presently. Numeral 28 designates a member which is mounted to be rotatable about a vertical axis. It is mounted by way of a pin or arbor 30 journaled in a hole in the base member 12 and it may be secured at the end by way of a securing member 32.

The pedal board or member 20 is mounted from the rotatable board or panel 28 so that it can be tilted vertically about a horizontal axis. Numerals 36 and 38 in FIG. 1 designate end brackets mounted on board 28 with a transverse shaft 40 journaled in them and extending underneath pedal board 20. In this manner the pedal board can be tilted a relatively small amount about the shaft 40 that it rests on.

It will be understood that indexing of the pedal board for the purposes of activation of individual elements is achieved by rotation of the pedal board about the axis of the pin or arbor 30. Actuation of individual control elements is achieved by way of tilting of pedal board 20 about the axis 40 and this tilting is of a relatively small magnitude. Torque transfer is provided by staple members as illustrated at 136 and 138—see FIG. 10.

At the end of the pedal board 20 it carries a pointer 46 which moves adjacent to a graduated scale of numbers, that is a scale numbered, for example, from 1 through 27 as shown in FIG. 1 illustrating 27 different positions, at each one of which there may be a control element that is to be separately actuated.

Arranged in the base board 12 in an arc as shown is a plurality of indexing holes one of which may be seen at 50 in FIG. 2. Adjacent to the end of pedal board 20 is a tapered indexing element or pin 52 which can cooperate with the arcuately arranged holes 50.

FIG. 3 is an enlarged cross-sectional view illustrating a preferred construction of the indexing holes 50 and the tapered indexing pins 52. Preferably the parts are constructed and arranged so that only a very small amount of vertical movement, that is a small amount of tilting movement is necessary for purposes of indexing the pedal to a particular indexing hole. Thus, the holes 50 are large enough to allow for only reasonable accuracy skill by the person operating the foot pedal in moving it angularly in order to index the foot pedal to a particular hole and control element as will be described. Each of the holes 50 is tapered as shown and sufficiently large at the outer end to allow at least a limited degree of relative movement by the pin 52 to again allow for some leeway with respect to the operator moving the pedal board 20 laterally for purposes of indexing the pointer 46 to a particular number and to a particular individual one of the holes 50.

Preferably, the pin 52 has a hardened end 53. The angle of tapered hole 50 is greater than the angle of pin 52 to avoid wedge-type lock-up. Dirt can pass through hole 50. Side walls of hole 50 can be hardened to facilitate ease and accuracy of indexing and reduce wear.

Numeral 58 designates a reed switch which is one of a plurality of such switches which are arranged in an arc and each one of which corresponds in position to one of the holes 50. Numeral 60 designates one of another plurality of similar reed switches arranged in an arc as shown in FIG. 1 the arc being of lesser radius but the switch corresponding angularly with the positions of the holes 50.

Figure 13:
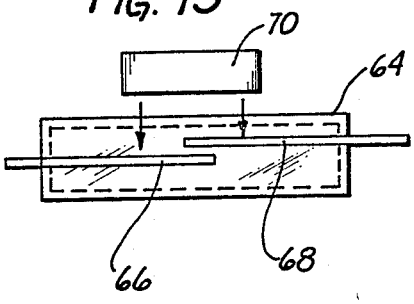
FIG. 13 is a schematic view of a reed switch.

The reed switches 58 and 60 may be of known design and construction. One form of reed switch is illustrated in FIG. 13. The showing in this figure is diagrammatic. Numeral 64 designates a housing which may be made of glass having in it two flexible contact members 66 and 68 which are of a type that can be caused to be brought into contact with each other by way of the presence of a permanent magnet as illustrated at 70. A particular advantage of the sealed reed switch is resistance to corrosion and contamination by a rough, dirty industrial or entertainment environment.

In FIG. 1 numeral 74 designates a permanent magnet carried by the pedal board 20 and numeral 76 designates a second permanent magnet also carried by the pedal board 20 at a shorter radial distance from stem or arbor 30. The magnet 74 cooperates with the reed switches such as designated by the numeral 58 and the permanent magnet 76 cooperates with the reed switches designated at 60. As shown the reed switches are embodied in the base board 12 but, of course, other similar arrangements are possible. The permanent magnets are, of course, moveable into adjusted positions in which they cooperate with the reed switches and which individual positions are index positions as established by actuation of the pedal board 20 in the manner already described wherein a tapered pin as shown at 52 is indexed into one of the holes 50 as described.

From the foregoing, the operation of the apparatus as so far described will be readily apparent from the description. The control device or switching mechanism may be positioned as illustrated in FIG. 12 wherein the operator is seated or as already stated it may be positioned in an orientation adapted for an operator in a standing position.

The operator's foot or shoe engages the top surface of the pedal board 20 and the operator is thus able to move the pedal board angularly so as to index it to any of the the positions identified by the numbers 1 through 27. When moving the pedal board angularly as explained, it is indexed to a particular position as identified by one of the numbers 1 through 27 and one of the holes 50 and the indexing pin 52. When actuating the pedal board to index, it is tilted about the shaft 40 to bring the pin 52 to one of the holes 50 so as to produce an accurate indexing and the permanent magnets 74 and 76 are brought into proximity to the reed switches 58 and 60 to actuate those switches. The series of switches 58, may of course, be electrically connected to control any type of control device for various different purposes. For instance, they may actuate a frequency changer which changes the frequency or "voice" of any type of musical instrument that is equipped with frequency changings for changing the pitch. Of course, these switches may actuate many different and varied types of mechanisms for example, various mechanisms that might be needed to be operated by a handicapped person who wants to have his hands available to perform other manual functions while performing certain functions by movement of his foot. In this respect, the invention may be utilized in many, many different adaptations wherein actuation of something by way of a person's foot is needed. In the exemplary embodiment the control elements are shown as electrical switches, but, of course, many varied and different types of control elements could similarly be adapted to be controlled by the foot actuated mechanism. For further example the invention might have use by an operator of a vehicle which requires use of the hands for guidance and control whereas other actions can be controlled by the foot or feet. Also, it would have value to a handicapped person suffering from palsy, for example.

The series of switches identified by the numeral 60 could of course, be employed to control or actuate other groups or systems of devices which it might be desired to have controlled by means of foot actuation.

The invention embodies whatever adjustments that may be needed or appropriate for purposes of accommodating a person's foot or shoe to the foot actuated pedal and the movements thereof.

Figure 4:
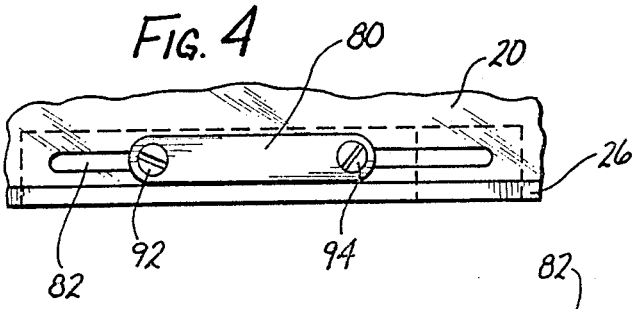
FIG. 4 is a plan or top view of a preferred form of adjustable heel stop to be used with the pedal board as shown in FIGS. 1 and 2.
Figure 5:
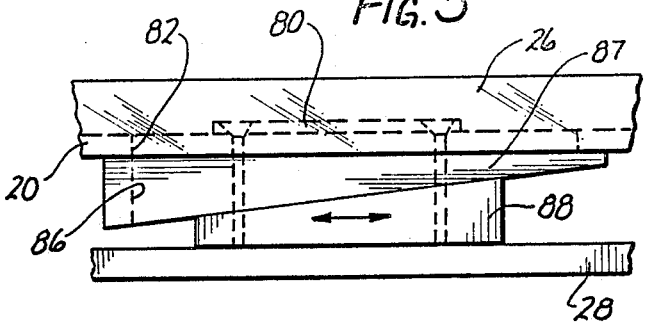
FIG. 5 is an elevational view of the adjustment device shown in FIG. 4.

Preferably there is provided an adjustment to limit the amount of tilting of the tiltable pedal board 20 around the axis 40 with respect to rotatable board 28. FIGS. 4 and 5 illustrate a preferred form of adjustment to control the amount of tilt of the pedal board 20 relative to the rotatable board. As illustrated in FIGS. 4 and 5, there is shown member 80 which can be slidably adjusted laterally in an elongated slot 82 which is formed in the rear end of the pedal board 20. Positioned between the end of the board and the rotatable board 28 are wedge members 87 and 88 having inclined surfaces as shown which bear against each other, the wedge members being positioned between the end of the tiltable pedal board 20 and the board 28.

Numerals 92 and 94 designate screw members with counter-sunk heads which extend through the ends of sliding member 80 and which extend down through the wedge member 87 and board 20 into wedge member 88, wedge member 87 being fixed to board 20. In this manner, the sliding member 80 along with the wedge member 88 can be adjusted laterally, the screws 92 and 94 moving in slot 86 and with the included surfaces of the wedge members 87 and 88 moving relatively to each other so as to adjust the stopping position or to limit the tilting position of the pedal board 20. Thus, the amount of tilt of pedal board 20 can be accurately adjusted so as to accommodate the correct amount of movement of the tapered pin 52 relative to the holes 50 and the positioning of the permanent magnet in proximity to the reed switches 58 and 60. Only a desired small amount of angular movement of tilt board 20 is needed to actuate a switch.

Referring to FIGS. 6 and 7, these figures illustrate an adjustment provided as part of the pedal board 20 to accommodate it to the length of an operator's foot or shoe. In these figures numeral 90 designates a heel member against which a person's shoe may be placed. The member 90 has a V-shaped construction 92 on its forward side so as to hold the heel of the shoe in position. The member 90 is moveable forwardly that is, fore-and-aft with respect to the pedal board 20. Numerals 94 and 96 designate a pair of adjusting screws having countersunk heads which extend through the holder member or block 90 and extend down to a sliding nut plate 98 underneath board 20. The screws 94 and 96 are moveable in a fore-and-aft direction, through a pair of elongated slots 100 and 102 in the pedal board 20 so that in this manner the position of the holder 90 for holding the heel of a foot or shoe can be adjusted to accommodate to the size or length of the foot or shoe. Graduations as identified at 104 are provided so as to be able to exactly adjust the holder member 90 to accommodate to the size of the foot or shoe. Holder 90 can accommodate a woman's spike heeled shoe. Angular adjustment of block 90 is permitted by screws 94 and 96 and slots 102 and 106.

FIGS. 8 and 9 illustrate means or mechanism adaptable to FIGS. 1 and 2 for adjusting to accommodate the width of the operators toe or forward part of the operators foot or shoe.

Numerals 106 and 108 designate positioning or adjustment members or blocks which are aligned with the sides 22 and 24 of the pedal board 20 as shown. Member 106 is held at the ends by way of screws 112 and 114 having countersunk heads which extend down through lateral slots as shown at 116 and 118 so that these screws can be loosened and the angular position of the holding member 106 can be adjusted and its position relatively to the side 24 of the pedal board 20 can be adjusted as desired. The screws 112 and 114 extend through pedal board 20 into sliding nut plate 107. At the opposite side of the pedal board 20 the member 108 is similarly adjustable as described for the member 106 the parts being identified by similar reference numerals primed. As can be seen therefore these holding members can be adjusted to accommodate to the width of a person's toe or foot or the person's shoe.

Figure 10:
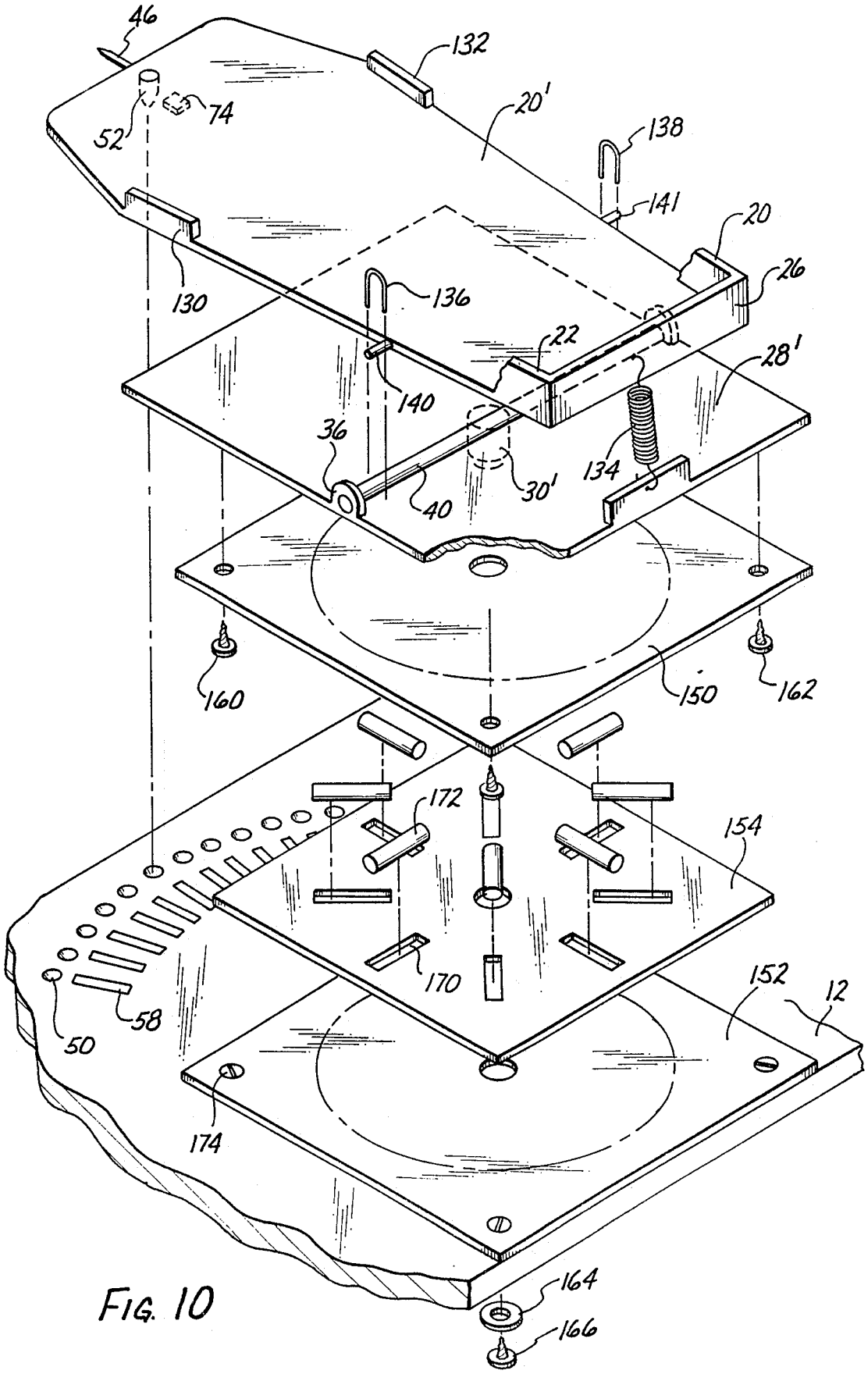
FIG. 10 is an exploded view of a form of the invention which is slightly modified with respect to that of FIGS. 1 and 2, particularly in that it embodies a roller bearing mount for the angular movement of the foot pedal.

FIG. 10 illustrates a modified form of the invention which in basic respects is similar to the embodiment of FIGS. 1 and 2. Parts or elements that are the same as corresponding parts in FIGS. 1 and 2 are identified by the same reference numerals, and parts that are basically similar but with some modification are identified with corresponding reference numerals primed.

The pedal board 20' is similar to that of the previous embodiment, being mounted over the rotatable board 28'. It is able to tilt or move angularly by reason of resting on the shaft 40 journaled in brackets such as shown at 36. As shown, the pedal board 20' has side portions at the forward part of the board as designated at 130 and 132. The rear part of the pedal board 20' is connected to the rotate board 28' by way of a spring, as designated at 134. Thus, the pedal board 20' is tilted or moved angularly against the tension of the spring 134 which, of course, can be made adjustable. The mechanism for adjusting the amount of tilt can be constructed as shown in detail in FIGS. 4 and 5 and applied to or used in this embodiment.

Similarly, the shoe or foot adjustment mechanisms as illustrated in FIGS. 6, 7, 8 and 9 can be applied to the pedal board 20' as shown in FIG. 10.

Numerals 136 and 138 designate U-shaped members or staples that are mounted on the rotate board 28' in a position to cooperate with laterally extending pins 140 and 141 on the pedal board 20' to limit the extent of its angular movement relative to the rotate board 28'.

With respect to the structure of FIG. 10 as so far described, it is similar to that of the previous embodiment except in the respects as have been identified.

In this embodiment of the invention, a roller bearing mechanism is provided in order to reduce as much as possible friction in the angular or rotate movements of the rotate board 28'.

The roller bearing mechanism includes an upper bearing retainer plate 150, a lower bearing retainer plate 152, and a bearing retainer plate 154. All of these plates, as shown, are square, but of course, the shapes could be varied. The upper bearing plate 150 preferably is attached to the rotate plate 28' by screws or bolts as illustrated at 160 and 162 which, as shown, are at the corners of the square plate and are exemplary of the means of attachment.

The shaft or arbor, which is designated at 30'. extends through the center of the upper and lower bearing plates and through the bearing retainer plate, and a fastening device may be provided at its end as indicated by way of a washer 164 and retaining screw 166.

The bearing retainer plate is, of course, mounted at the center by way of the pin or arbor 30'. It has in it a plurality of radially positioned slots, such as the one designated at 170. As shown, there are eight of these radial openings, although other numbers could be used. Positioned in these radial openings are elongated cylindrical bearing members, one of which is designated at 172, there being one in each of the radial openings. Thus, when assembled, the radially positioned roller bearing members 172 bear against the bottom bearing plate 152 and against the upper bearing plate 150. The result is that the roller bearing, as thus described, minimizes friction in the rotation of the rotate plate 28' and the pedal board 20' which, of course, rotates with it and, as explained, can be moved angularly about the axis of the shaft 40.

The lower bearing plate 152 is mounted on the base plate 12 by way of screws as shown at its corners and as designated at 174.

From the foregoing, the manner of utilization and the operation of the embodiment as shown in FIG. 10 will be readily understood, the operation being like that of the first embodiment, and the positioning of the foot being done similarly as illustrated in FIGS. 4–9, the tilt adjustment of the pedal board 20' being like that of the previous embodiment as illustrated in FIGS. 4 and 5.

Figure 11:
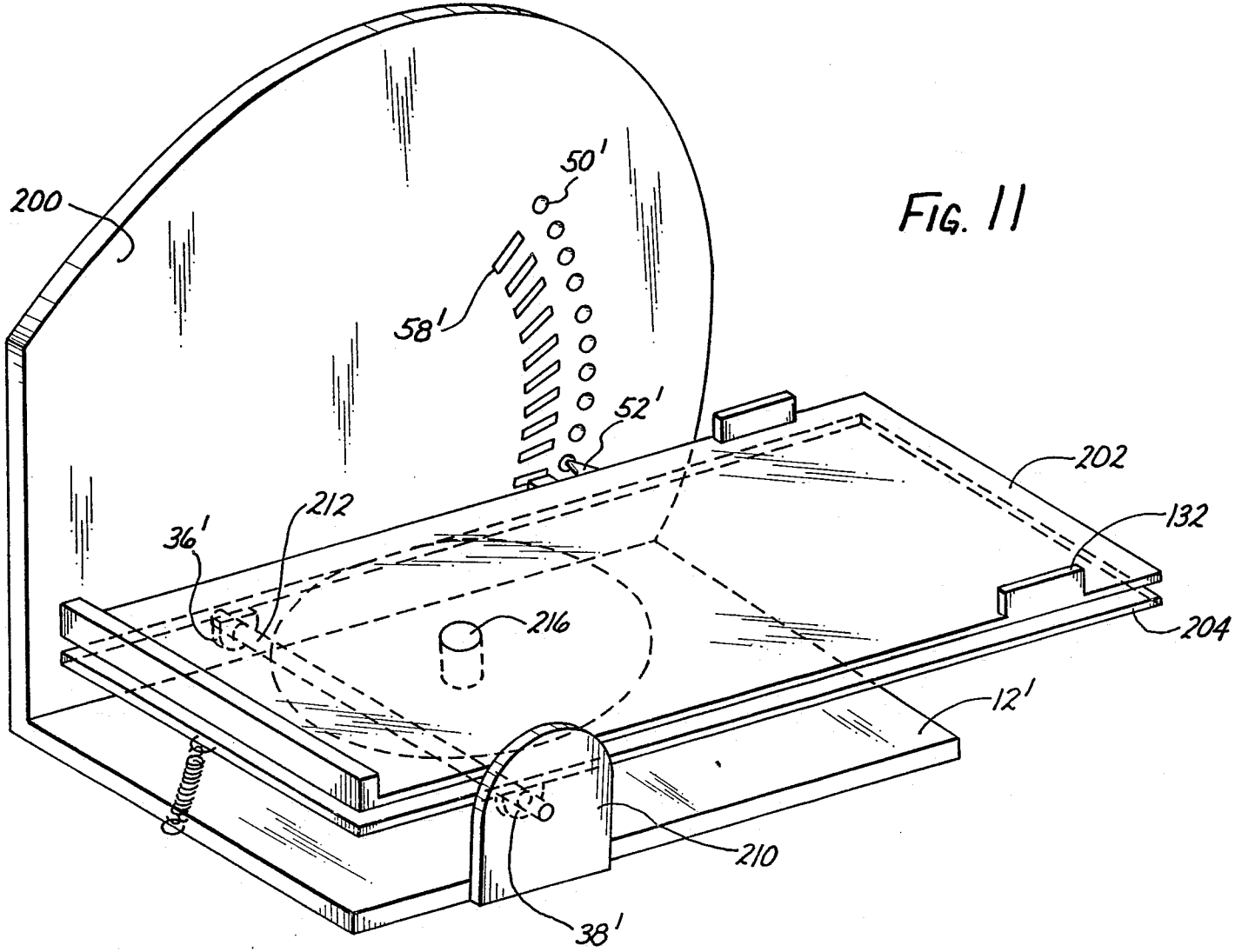
FIG. 11 is an isometric view of a second form of the invention in which the rotate board or pedal is over the tilt board and moves angularly for purposes of indexing.

FIG. 11 illustrates a further modified form of the invention. In this form of the invention, the rotatable board is mounted over the tilt board or panel rather than the tilting pedal board being over the rotating board.

The base member in FIG. 11 is designated at 12'. At one side of the base member is an upright or vertical member 200. The indexing pin is designated at 52', and it is positioned at one side of the pedal board 202 which, as explained, is positioned over the tilt board 204. Provided in the upright panel 200 is a similar series of holes arranged in an arc, one of the holes being designated at 50' and these holes corresponding to the holes 50 of the previous embodiment. Similarly, there is provided in association with the holes a series of reed switches, one of which is designated at 58', arranged in an arc. The indexing pin 52', the holes 50', and the reed switches 58' are like those of the previous embodiment. The difference is that they are arranged in the upright panel 200, and the pedal board 202 is moved angularly for purposes of indexing the pin 52' in a particular one of the holes 50'. Similarly to the previous embodiment, only a relatively small amount of angular movement of the pedal board 202 is required to effect accurate indexing of the indexing pin 52' in one of the holes 50'.

Upstanding from the base member 12 is a bracket member 210, and extending between this bracket member and the upright member 200 is a tilt shaft 212, the ends of which are journaled in bracket ears 36' and 38' on the tilt board 204. The tilt board 204 is mounted to be able to tilt relative to the shaft or axis 212. The board 202 is mounted to rotate with respect to the tilt board 204, although the two tilt together. The pedal board 202 is mounted by way of a central pin or pivot 216 which extends from the tilt board 204. The operation of the form of the invention of FIG. 11 is like that of the previous embodiment except that indexing is by way of the up and down movement and switch actuation is by way of lateral movement.

From the foregoing, those skilled in the art will readily understand the nature of the invention and the manner of its construction, and its manner of utilization. The foregoing disclosure is representative of preferred forms or embodiments of the invention and is intended to be illustrative rather than limiting upon the invention. It is intended that the claims appended hereto shall cover all of the forms of the invention as disclosed, as well as equivalents and/or equivalent adaptations of the invention. It is to be understood, of course, that the invention may be applied or made use of in many and varied adaptations and applications, in addition to those that have been specifically referred to in the foregoing. By way of further example, the invention might be utilized in connection with the control or operation of devices, such as machining tools or many other types of instrumentalities of devices which embody controls or instrumentalities which require the use of the hands so that further controls require manipulation by a foot or feet of an operator. The range of possible utilizations or adaptations is very great. For example, there may be envisaged the use of the device in the control of military vehicles, wherein the use of the operator's hands is fully occupied in the control and guidance of the vehicle along with instruments requiring manual attention so that other operations or manipulations need to be executed by manipulation of a foot or feet or other bodily part. Such additional manipulations might include, for example, the guidance, control, and operation of such things as communications equipment, ordnance, command requirements, etc.

With respect to individual components of the inventions, in all instances, it is intended that the invention shall embrace whatever equivalent components might be selected, suggested or used. Thus, the invention is intended to embrace equivalent components or instrumentalities for indexing; for control; for actuating control elements; for producing the necessary movements for indexing and for control, etc.

What is claimed is:

1. As an article of manufacture, a control device, the device having a plurality of control elements arranged in a series relationship, an actuating member, said actuating member including at least one first part angularly movable about a first axis and including at least one second part angularly movable about a second axis, said first part being angularly moveable to select a control element for actuation and said second part being movable to actuate a selected control element and further including indexing means, the indexing means comprising at least one plug pin, said control device further including a plurality of holes such that at least one hole is associated with each one of said plurality of control elements, each of said plug pins being configured to be moveable within said holes for actuation of a selected control element.

2. The invention as set forth in claim 1, wherein the said axes are substantially normal to each other, one of said parts being carried by the other part.

3. The invention as set forth in claim 1, wherein one of said parts is rotatable to select and align with a control element and the other said part is tiltable to actuate a selected control element.

4. The invention as set forth in claim 1, wherein said plug pins are tapered and wherein the plurality of control elements comprises a plurality of electrical switches.

5. The invention as set forth in claim 4, wherein the said switches are reed-type switches, the actuating member including magnetic means positioned to actuate individual switches upon the motion of said control member such that a plug pin thereon passes through a hole associated with a selected control element.

6. The invention as set forth in claim 1, wherein said actuating member includes a part adapted to be engaged by a human being's foot.

7. An article as in claim 6, wherein said part to be engaged by a person's foot includes adjustable means in the form of a heel stop constructed to provide adjustment accommodating to length of a shoe or foot.

8. An article as in claim 6, wherein said foot engageable part includes an adjustable means for adjusting with respect to foot or shoe size in a fore-and-aft direction, the said adjustment comprising an adjustable member to accommodate a fore-and-aft adjustment of a heel or a foot, as well as angularly with respect to a heel.

9. An article as in claim 6, including adjustable means carried by said foot part providing an adjustment to accommodate for width of a toe part of the user comprising members positioned on each side of the toe area constructed to be movable laterally and also angularly.

10. The invention as set forth in claim 1, wherein one of the said parts is mounted such that it is movable angularly about a substantially vertical axis and the second part is mounted to provide for angular tilting movement about said second axis substantially normal to said first axis.

11. An article as in claim 1 wherein one of said parts is mounted to rotate about an axis, and means providing a roller bearing for said one part.

12. The invention as set forth in claim 1, wherein one of said parts is mounted to rotate about a vertical axis, the other of said parts being mounted to have a tilting movement relative to the first part, and further including a transverse shaft with the other part resting on said shaft so as to provide for tilting movement about the shaft.

13. The invention as set forth in claim 1 wherein said actuating device is laterally movable for selecting a control element and movable in an up and down movement for activating a selected control element.

14. An article as in claim 1 wherein the said plurality of control elements in a series relationship is mounted in a substantially vertical orientation, and means whereby the actuating device in one mode of movement for indexing is an up and down movement.

15. An article as in claim 14 wherein the mode of movement for actuating one of the control elements is in a lateral direction.

16. An article as in claim 1, wherein the holes are tapered to receive the pins.

17. A control device constructed for operation by a human, the device having a plurality of control elements arranged in a series relationship, an actuating member to be actuated by a human, means whereby the said member has a first mode of movement and has a second mode of movement, and means whereby the actuating device in one mode of movement indexes the actuating device for actuating one of said control elements, and means whereby the device in the second mode of movement actuates one of said control elements that has been indexed, wherein one of said parts is mounted to rotate about an axis, and means providing a roller bearing for said one part.

* * * * *